US011815045B2

(12) United States Patent
Gaiselmann et al.

(10) Patent No.: US 11,815,045 B2
(45) Date of Patent: Nov. 14, 2023

(54) CYLINDER LINER FOR AN INTERNAL COMBUSTION ENGINE

(71) Applicant: Mahle International GmbH, Stuttgart (DE)

(72) Inventors: Stefan Gaiselmann, Stuttgart (DE); Bartek Lemm, Altbach (DE); Ricardo Daltio Riceto, Stuttgart (DE); Thomas Stibleichinger, Tumeltsham (AT)

(73) Assignee: Mahle International GmbH

( * ) Notice: Subject to any disclaimer, the term of this patent is extended or adjusted under 35 U.S.C. 154(b) by 0 days.

(21) Appl. No.: 17/838,672

(22) Filed: Jun. 13, 2022

(65) Prior Publication Data

US 2022/0397077 A1 Dec. 15, 2022

(30) Foreign Application Priority Data

Jun. 11, 2021 (DE) ..... 102021205978.3

(51) Int. Cl.
*F02F 1/20* (2006.01)
*F02F 1/00* (2006.01)

(52) U.S. Cl.
CPC ..... *F02F 1/004* (2013.01)

(58) Field of Classification Search
CPC ..... F02F 1/004; F02F 1/20
See application file for complete search history.

(56) References Cited

U.S. PATENT DOCUMENTS 10,294,885 B2 5/2019 Bettini et al.
10,294,890 B2 5/2019 Da Rocha Mordente et al.
10,605,194 B2 3/2020 Rainer et al.
2019/0085787 A1* 3/2019 Bettini Rabello ..... B24B 1/005
2020/0256277 A1* 8/2020 Kawai ..... F16J 10/00

FOREIGN PATENT DOCUMENTS

DE 1576404 A1 3/1970
DE 102011117660 A1 5/2013
DE 112014005506 T5 12/2013
(Continued)

OTHER PUBLICATIONS

English abstract for DE-102016205754.
(Continued)

*Primary Examiner* — George C Jin
*Assistant Examiner* — Teuta B Holbrook
(74) *Attorney, Agent, or Firm* — Fishman Stewart PLLC

(57) ABSTRACT

A cylinder liner for an internal combustion engine may include a hollow-cylindrical liner body, which may have an inner circumferential surface including a first axial portion and a second axial portion. The first axial portion may open at a first opening angle towards the second axial portion. The second axial portion may open at a second opening angle away from the first axial portion. The second opening angle may be greater than the first opening angle. A first surface roughness in the first axial portion may be greater than a second surface roughness in the second axial portion. A plateau aspect in the second axial portion, which may be defined as R3p=Rvk/(Rpk+Rk), may be 0.2 to 1.6. A texture height in the second axial portion, which may be defined as R3k=Rpk+Rk+Rvk, may be 0.4 μm or less.

20 Claims, 1 Drawing Sheet

(56) References Cited

FOREIGN PATENT DOCUMENTS

| | | | | |
|---|---|---|---|---|
| DE | 102013013943 | B3 | | 1/2015 |
| DE | 102014017361 | A1 | | 6/2016 |
| DE | 102016205754 | A1 | | 10/2017 |
| DE | 102017215335 | A1 | | 3/2018 |
| JP | 2013113275 | A | * | 6/2013 |

OTHER PUBLICATIONS

English abstract for DE-102011117660.
English abstract for DE-102013013943.
English abstract for DE-10 2014 017 361.
German Search Report for DE-102021205978.3, dated Aug. 23, 2021.

* cited by examiner

CYLINDER LINER FOR AN INTERNAL COMBUSTION ENGINE

CROSS-REFERENCE TO RELATED APPLICATIONS

This application claims priority to German Patent Application No. DE 10 2021 205 978.3, filed on Jun. 11, 2021, the contents of which is hereby incorporated by reference in its entirety.

TECHNICAL FIELD

The present invention relates to a cylinder liner for an internal combustion engine and to an internal combustion engine having such a cylinder liner. Further, the invention relates to a motor vehicle having such an internal combustion engine.

BACKGROUND

Cylinder liners, which open away from the combustion space in order to compensate for the heat expansion that occurs mainly above in the combustion space are known from the prior art. Such cylinder liners are disclosed for example by DE 1 576 404 A1 and DE 10 2013 013943 B3.

Likewise known from the prior art are cylinders liners in which a surface roughness of the inner circumferential side of the liner varies. Before this background, DE 11 2014 003421 T5 proposes providing a surface with high roughness both in the region of the top and also bottom reversal point of the piston sliding along the cylinder liner. In both reversal points, high pressure forces can develop because of the pressure that is present there and a possible "tilting" of the piston. The deep roughness texture of the surface therefore serves for storing oil which allows an effective lubrication of the piston in this region. In the region between the two reversal points, in which the piston can move rapidly, the sliding friction that occurs between the piston or its piston rings and the inner circumferential side of the cylinder liner can be kept low by providing a surface with a bottom roughness—i.e. by providing a smooth(er) surface.

DE10 2014 017 361 A1 combines the idea explained above with the idea of widening the cylinder liner in the middle region, wherein the resulting additional clearance in the middle region further reduces the sliding friction that occurs between piston and cylinder liner or its piston rings.

SUMMARY

The object of the present invention is to show new ways in developing cylinder liners for internal combustion engines.

This object is solved through the subject matter of the independent patent claim(s). Preferred embodiments are the subject matter of the dependent patent claim(s).

Accordingly, the basic idea is to vary along the axial direction of a cylinder liner both the liner diameter and also the surface roughness of the inner circumferential side of the cylinder liner determining the liner diameter. Here it is substantial for the invention to furnish a first axial portion of the cylinder liner which, when used in an internal combustion engine, is assigned to the top reversal point of the piston, i.e. facing the combustion space, with a greater surface roughness than a second axial portion further distant from the top reversal point. According to the invention, an increase of the liner diameter of the cylinder liner in the first axial portion is selected smaller seen in the axial direction from the first to the second axial portion than in the second axial portion. In this way it is ensured in the first axial portion of the cylinder liner facing the combustion space that the piston is guided with a low radial clearance and with good lubrication even under high gas pressure. In the second axial portion further distant from the combustion space the sliding friction between piston and cylinder liner is kept very low because of the resulting greater radial clearance and the reduced surface roughness. Here it proves to be substantial for the invention to keep the entire texture height of the surface and also the plateau aspect small in the second axial portion.

These characteristics are described based on the characteristic variables Rk, Rvk and Rpk, as these are defined in the standard DIN EN ISO 13565-2. Accordingly, Rk is the depth of the roughness core profile also known by the designation "core peak to valley height" to the person skilled in the art. In addition, Rpk is the mean height of the peaks protruding out of the core region, which is also familiar to the relevant person skilled in the art by the term "reduced peak height". Finally, Rvk is the mean depth of the peaks protruding out of the core region, which is known to the pertinent person skilled in the art by the term "reduced valley depth". Rpk describes the peak area and thus the running-in behaviour of the surface of the inner circumferential side. Rk describes the core area as carrying part of the profile. Rvk describes the valley and pore areas and thus influences the oil retention volume and the long-term behaviour.

The abovementioned texture height of the inner circumferential side in the second axial portion is defined as R3k=Rpk+Rk+Rvk.

The abovementioned plateau aspect of the inner circumferential side in the second axial portion is defined as R3p=Rvk/(Rpk+Rk).

R3p, i.e. the plateau aspect describes the characteristic of the contact and core region relative to the surface valleys. R3k, i.e. the texture height SH2, describes the overall roughness of the honing texture without extreme peak and valley regions.

The plateau aspect of the inner circumferential side in the second axial portion according to the invention amounts to between 0.2 and 1.6, preferentially between 0.6 and 1.6, most preferentially between 0.6 and 0.8. The texture height of the inner circumferential side in the second axial portion according to the invention amounts to maximally 0.4 μm. Experimental investigations have shown that in this way a surface is created which has the characteristic of a finely ground running surface. In this way, a particularly thin oil film can be realised in the second axial portion so that the piston moved with relatively high speed in the second axial region merely needs to push a relatively small quantity of oil ahead of it. This leads to advantageously reduced friction effects.

As a result, a cylinder liner is thus created in which a piston of an internal combustion engine can be guided with particularly low sliding friction yet in a mechanically precise manner.

A cylinder liner for an internal combustion engine according to the invention includes a hollow-cylindrical liner body extending along an axial direction. The inner circumferential side of the same comprises along the axial direction at least one first and one second axial portion. The inner circumferential side, preferentially in a longitudinal section along the axial direction, is formed by the cylindrically in the first portion or opens in the first axial portion at a first opening angle towards the second axial portion, namely preferentially conically. This means that the liner diameter of the liner body determined by the inner circumferential side has a constant value along the axial direction and in the first axial portion or that this value increases along the axial direction. In the latter case, the first axial portion thus tapers away from the second axial portion.

Further, the second axial portion opens at a second opening angle away from the first axial portion—namely preferentially conically, wherein the second opening angle is greater than the first opening angle which, if applicable, is likewise present in the first axial portion. This means that the liner diameter of the liner body determined by the inner circumferential side has a value along the axial direction in the second axial portion which increases along the axial direction, i.e. away from the combustion space of the internal combustion engine towards a crankshaft. Here, the value of the liner diameter increases more in the second axial portion than in the first axial portion. Typical values for the opening angle in the first axial portion are in the range between 0 and 5 angular minutes. Typical values for the opening value in the second axial portion are in the range between 4 and 25 angular minutes.

According to the invention, a first surface roughness of the inner circumferential side is greater in the first axial portion than a second surface roughness of the inner circumferential side in the second axial portion. The plateau aspect of the inner circumferential side defined above in the second axial portion according to the invention amounts to between 0.2 and 1.6, preferentially between 0.6 and 1.6, most preferentially between 0.6 and 0.8. The texture height of the inner circumferential side defined above in the second actual portion is defined as R3k=Rpk+Rk+Rvk and according to the invention amounts to maximally 0.4 μm, preferentially maximally 0.2 μm.

By means of the determination of the plateau aspect and of the texture height according to the invention, the friction developing between the piston and the cylinder liner can be reduced since the ring package in the predominantly hydrodynamic region utilises the low oil retention volume and pushes a significantly reduced oil quantity in front of it. According to a preferred embodiment, the first surface roughness of the inner circumferential side in the first axial portion amounts to RpK<0.15 μm, wherein Rk<0.5 μm and Rvk μm between 0.2 μm and 1.5 μm.

According to a further preferred embodiment, the second surface roughness of the inner circumferential side in the second axial portion amounts to Rpk<0.05 μm, wherein Rk<0.15 μm and Rvk<0.2 μm.

According to an advantageous further development, the liner body can comprise a third axial portion in which the inner circumferential side is formed cylindrically or opens away from the second axial portion at a third opening angle, preferentially conically. This means that the liner diameter of the liner body determined by the inner circumferential side has a value along the axial direction in the third axial portion which along the axial direction either remains the same or increases further relative to the second portion. In this further development, the second axial portion is thus axially arranged between the first and third axial portion. In this further development, the sliding friction that occurs between the cylinder liner and the piston guided in the cylinder liner is further decreased because of the additional radial clearance present in the third portion.

Particularly preferably, a third surface roughness of the inner circumferential side in the third axial portion is smaller than the first surface roughness in the first axial portion. This measure is also accompanied by improved friction characteristics, in particular reduced friction values of the cylinder liner.

According to a further advantageous further development, a radial widening of the cylinder liner measured—based on a centre longitudinal axis of the cylinder liner—perpendicularly to the axial direction can be up to 100 μm, preferentially approximately 50 μm. These values are preferred with cylinder liners for heavy duty vehicles having typical inner diameters in the range from 120 to 140 mm. Regardless of the diameter of the cylinder liner concerned, measured widenings emanating radially from a centre longitudinal axis in a range from 0.025% to 0.05% of the cylinder inner diameter are considered particularly advantageous. The radial clearance increasing along the axial direction accompanies by this reduces the sliding friction that occurs between piston and cylinder liner in a particularly advantageous way.

Practically, the generatrix of the inner circumferential side can follow a curved course in the longitudinal section along the axial direction in the first axial portion and—alternatively or additionally—in the second axial portion. Alternatively or additionally, the generatrix of the inner circumferential side can follow a straight line in the first axial portion and—alternatively or additionally—in the second axial portion. While straight line generatrices can delimit a conical or cylindrical space, curved generatrices can produce a widening that is progressive from the combustion space in the direction of the crankshaft—in particular trumpet or bell-shaped. Thus, fine adaptations of the contour of the inner circumferential side of the liner body to user-specific requirements are possible.

In the case that the liner body, further, comprises the third axial portion explained above, the inner circumferential side in the longitudinal section along the axial direction can follow a curved course in the third axial portion according to an advantageous further development. However it is also conceivable, alternatively to this that in the longitudinal section along the axial direction the inner circumferential side follows a straight line in the third axial portion. In this way, fine adaptations of the contour of the inner circumferential side of the liner body to user-specific requirements are also possible.

In further preferred variants it is conceivable that one or more (first) sub-portions of the first, second and/or third axial portions 4*a*, 4*b*, 4*c* are formed in a straight line and one or more (second) sub-portions of the first, second and/or third axial portions 4*a*, 4*b*, 4*c* are designed curved.

In a further preferred embodiment, the second axial portion directly follows the first axial portion along the axial direction. This embodiment requires particularly little installation space in the axial direction.

In a further preferred embodiment, the third axial portion directly follows the second axial portion along the axial direction. This embodiment also requires particularly little installation space in the axial direction.

Further, the invention relates to an internal combustion engine for a motor vehicle having at least one cylinder bore, which on the circumference side is delimited by a cylinder liner according to the invention introduced above. The advantages of the cylinder liner explained above therefore apply also to the internal combustion engine according to the invention. In the cylinder bore—adjustable along the axial direction of the cylinder liner between an top reversal point and a bottom reversal point—a piston of the internal combustion engine is arranged. Obviously, the internal combustion engine can also comprise two or more cylinder bores, each with a cylinder liner according to the invention and a piston as explained above. According to the invention, the top reversal point is arranged in the first axial portion of the cylinder liner.

According to a preferred embodiment, in which the cylinder liner is formed in particular without third axial portion, the bottom reversal point is arranged in the second axial portion of the cylinder liner.

According to a preferred embodiment alternative thereto—in which the cylinder liner comprises the third axial portion explained above—the bottom reversal point of the piston can be arranged in exactly this third axial portion of the cylinder liner.

Finally, the invention relates to a motor vehicle having an internal combustion engine according to the invention and thus having at least one cylinder liner according to the invention. The advantages of the internal combustion engine according to the invention or of the cylinder liner according to the invention explained above therefore apply also to the motor vehicle according to the invention.

Further important features and advantages of the invention are obtained from the subclaims, from the drawings and from the associated figure description by way of the drawings.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference numbers relate to same or similar or functionally same components.

BRIEF DESCRIPTION OF THE DRAWINGS

It shows, in each case schematically.

DETAILED DESCRIPTION

Figure 1:
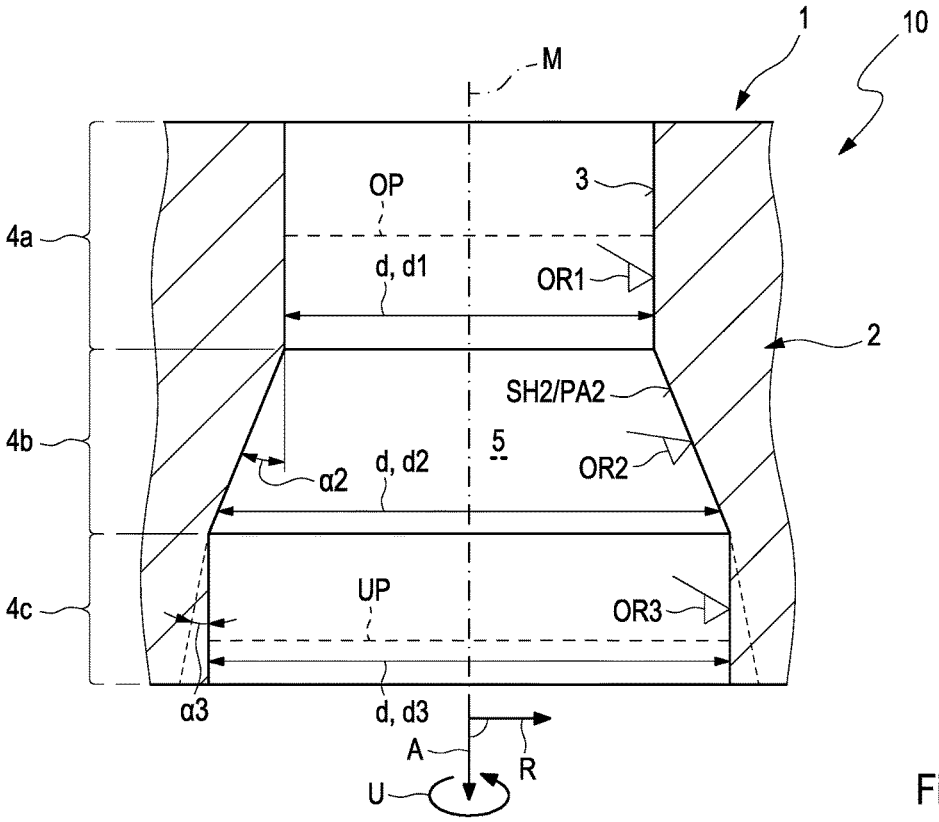
FIG. 1 shows a first example of a cylinder liner according to the invention, in which the first axial portion of the inner circumferential side is formed cylindrically, i.e. without opening angle.

FIG. 1 illustrates, in a longitudinal section along an axial direction A, a first example of a cylinder liner 1 according to the invention for an internal combustion engine of a motor vehicle which is not shown. The cylinder liner 1 includes a hollow-cylindrical liner body 2 extending along the axial direction A, whose inner circumferential side 3 comprises, along the axial direction A, a first, second and third second axial portion 4*a*, 4*b*, 4*c*. The second axial portion 4*b* is arranged along the axial direction A between the first and third axial portion 4*a*, 4*c*.

The axial direction A extends along a centre longitudinal axis M of the liner body 2, while a radial direction extends perpendicularly to the axial direction A away from the centre longitudinal axis M. A circumferential direction U—extending perpendicular both to the axial direction A and also to the radial direction R—encircles the centre longitudinal axis M. In a simplified variant of the example (not shown), the third axial portion 4*c* can be omitted.

A possible material for the liner body 2 for example is aluminium, steel or cast iron.

In the example of FIG. 1, the inner circumferential side 3 in the first axial portion 4*a* is formed cylindrically, as shown—i.e. without opening and without taper and thus at an opening angle zero. Thus, the inner circumferential side 3 extends in the first axial portion 4*b* along the axial direction A and parallel to the centre longitudinal axis M. This means that the liner diameter d determined by the generatrix of the inner circumferential side 3 of the liner body 2 has a constant value d1 along the axial direction A in the first axial portion 4*a*.

Figure 2:
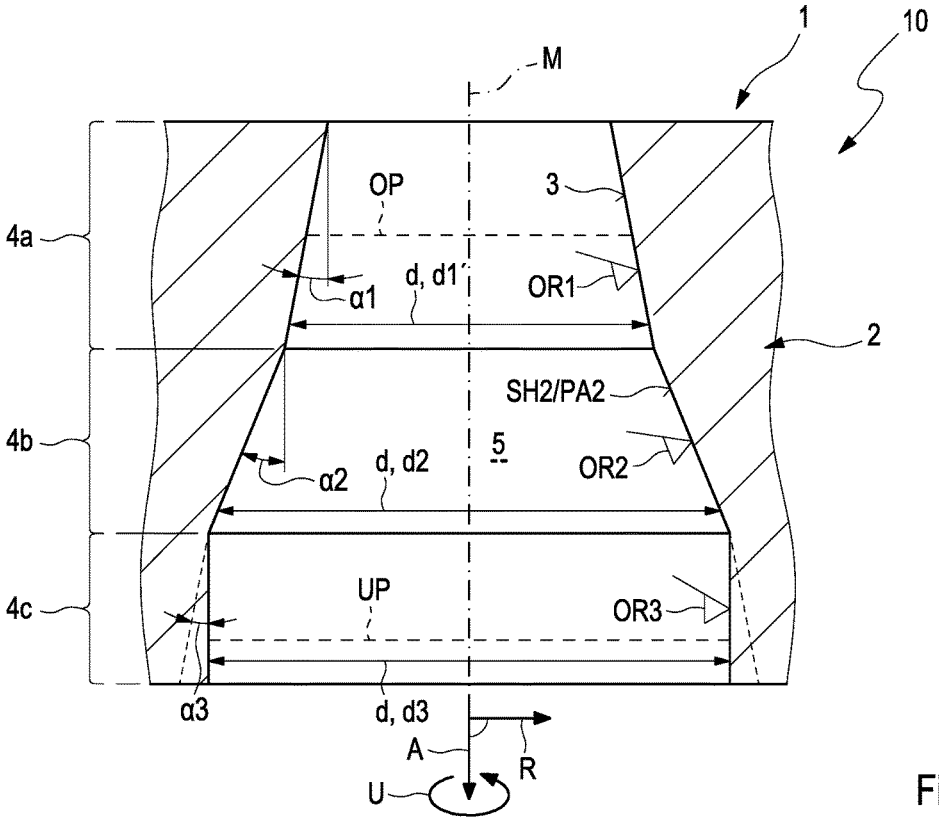
FIG. 2 shows a second example of a cylinder liner according to the invention, in which the first axial portion of the inner circumferential side opens conically towards the second axial portion.

FIG. 2 shows a scenario alternative thereto. Accordingly, the first axial portion 4*a* can open—preferentially conically—at a first opening angle $\alpha$1 towards the second axial portion, i.e. taper away from the second axial portion 4*b*—preferentially conically. In the shown longitudinal section along the axial direction A, the opening angle $\alpha$1 corresponds to the intermediate angle between the first axial portion 4*a* of the inner circumferential side 3 and the centre longitudinal axis M of the liner body 2. This means that along the axial direction A in the first axial portion 4*a* the liner diameter d of the liner body 2 determined by the generatrix of the inner circumferential side 3 has a value d1' increasing along the axial direction A.

Both in the example of FIG. 1 and also in that of FIG. 2, the second axial portion 4*b* opens at a second opening angle $\alpha$2 away from the first axial portion, namely preferentially conically. In the longitudinal section shown in each of the figures along the axial direction A, the opening angle $\alpha$2 corresponds to the intermediate angle between the second axial portion 4*b* of the inner circumferential side 3 and of the centre longitudinal axis M of the liner body 2.

This means that the liner diameter d of the liner body 2 determined by the inner circumferential side 3 has, along the axial direction A, a value d2 increasing along the axial direction A in the second axial portion 4*b*. Here, the second opening angle $\alpha$2 of the second axial portion 4*b* is greater than the possibly existing first opening angle $\alpha$1 of the first axial portion 4*a*. This means that the value d2 of the liner diameter d increases more in the second axial portion 4*b* than the value d1' of the liner diameter d in the first axial portion 4*a*. The two opening angles $\alpha$1, $\alpha$2 are shown enlarged in the FIGS. 1 and 2 for the sake of better illustration. Typical values for the opening angle $\alpha$1 are in the range between 0 and 5 angular minutes. Typical values for the opening angle $\alpha$2 are in the range between 4 and 25 angular minutes.

Apart from this, the liner body 2, can comprise, in both examples as shown in the FIGS. 1 and 2, a third axial portion 4*c*, in which the inner circumferential side 3 is formed cylindrically or opens (shown in dashed lines each in the FIGS. 1 and 2) at a third opening angle $\alpha$3 away from the second axial portion 4*c*, preferentially conically. This means that the value d3 of the liner diameter d of the liner body 2 determined by the inner circumferential side 3 has a constant value d3 along the axial direction A in the third portion 4*c* or increases. In a respective simplified variant both of the example of FIG. 1 and also of the example of FIG. 2 the third axial portion 4*c* can be omitted.

In each of the exemplary scenarios explained above, a widening of the cylinder liner 1, originating from the centre longitudinal axis M along the radial direction R, i.e. measured perpendicularly to the axial direction A, can be up to 100 μm, preferentially approximately 50 μm.

In the examples of the FIGS. 1 and 2, a first surface roughness OR1 of the inner circumferential side 3 in the first axial portion 4*b* is greater than a second surface roughness OR2 in the second axial portion 4*b*. Further, a third surface roughness OR3 of the inner circumferential side 3 is smaller in the third axial portion 4*c*—provided this third portion 4*c* is present—is smaller than the first surface roughness OR1. The third surface roughness OR3 can, in an embodiment variant, be equal to the second surface roughness OR2, but alternatively thereto, also smaller or greater than the second surface roughness OR2. Thus, the surface roughness of the inner circumferential side 3 in the region of the first axial portion 4*a* is maximal, i.e. OR1>OR2. OR1>OR3 may also apply where appropriate.

For example, the first surface roughness OR1 of the inner circumferential side 3 can be characterised in the first axial portion 4*a* by a value Rpk<0.15 μm, by a value Rk<0.5 μm and by a value Rvk between 0.2 μm and 1.5 μm. Apart from this, the second surface roughness OR2 of the surface of the inner circumferential side 3 in the second axial portion 4*b* can have a value RpK<0.05 μm and a value Rk<0.15 μm and Rvk a value <0.2 μm. Here, Rk is the roughness of the roughness core profile, i.e. the so-called "core roughness". Further, RpK is the average height of the peaks protruding out of the core region, i.e. the so-called "reduced peak height". Finally, Rvk is the average depth of the grooves protruding out of the core region, i.e. the so-called "reduced valley depth".

A plateau aspect PA2 of the inner circumferential side 3 in the second axial portion 4*b* is defined as R3p=Rvk/(Rpk+Rk) and is between 0.2 and 1.6, preferentially between 0.6 and 1.6, most preferentially between 0.6 and 0.8. A texture height SH2 of the inner circumferential side 3 in the second axial portion 4*b* is defined as R3k=Rpk+Rk+Rvk and amounts to maximally 0.4 μm, preferentially maximally 0.2 μm.

Thus, R3p describes the characteristic of the contact and core region relative to the surface valleys. R3k thus describes the overall roughness of the honing texture without extreme peak and valley regions.

The desired surface roughness and the plateau aspect PA2 and the texture height SH2 can be created by honing the axial portion 4*a*, 4*b*, 4*c* of the inner circumferential side 3 concerned. Applying a texture to the axial portion 4*a*, 4*b*, 4*c* of the inner circumferential side 3 concerned is also conceivable, for example with the help of a suitable laser or etching process In the two FIG. 1 and shown longitudinal section along the axial direction A, the inner circumferential side 3 in the first, second and third axial portion 4*a*, 4*b*, 4*c* follows a straight line course in each case. However a curved design of two or of all three axial portions 4*a*, 4*b*, 4*c* (not shown in the figures for the sake of clarity) is also conceivable. It is also conceivable that one or more (first) sub-portions of the first, second and/or third axial portion 4*a*, 4*b*, 4*c* are formed in a straight line and one or more (second) sub-portions of the first, second and/or third axial portion 4*a*, 4*b*, 4*c* are formed curved.

In the example of the FIGS. 1 and 2, the second axial portion 4*b* along the axial direction A directly follows the first axial portion 4*a*. Likewise, the third axial portion 4*c* along the axial direction A directly follows the second axial portion 4*b*. Thus, the three portions 4*a*, 4*b*, 4*c* directly merge into one another.

In a first optional variant of the examples, an axial intermediate portion (not shown) having a suitable contour profile of the inner circumferential side 3 between the first and second axial portion 4*a*, 4*b* can be formed cylindrically or with an opening angle both in a straight line or curved.

In a second optional variant of the example, an axial intermediate portion (not shown) having a suitable contour profile of the inner circumferential side 3 between the second and the third axial portion 4*a*, 4*c*, can be formed cylindrically or with opening angle as well as in a straight line or curved. The first variant can be combined with the second variant.

The cylinder liner 1 of the FIGS. 1 and 2 can be used in an internal combustion engine 10, so that it delimits a cylinder bore 5 of the internal combustion engine on the circumferential side. Here, the internal combustion engine 10 includes a piston that is adjustably arranged in the cylinder bore 5 between an top reversal point OP and a bottom reversal point UP, which is not shown in the figures for the sake of clarity.

As illustrated by the figures, the top reversal point OP is arranged in the first axial portion 4*a* of the cylinder liner 1. The bottom reversal point UP is arranged in the third axial portion 4*c*. In the case of the simplified variants of the cylinder liner 1 without third axial portion 4*c* mentioned above, the bottom reversal point UP can be arranged in the second axial portion 4*b*.

The invention claimed is:

1. A cylinder liner for an internal combustion engine, comprising:

a hollow-cylindrical liner body extending along an axial direction, the liner body having an inner circumferential surface including, along the axial direction, a first axial portion and a second axial portion;

the first axial portion formed one of cylindrically and conically, and opening at a first opening angle towards the second axial portion;

the second axial portion opening at a second opening angle away from the first axial portion;

wherein the second opening angle is greater than the first opening angle;

wherein a first surface roughness of the inner circumferential surface in the first axial portion is greater than a second surface roughness in the second axial portion;

wherein a plateau aspect of the inner circumferential surface in the second axial portion, which is defined as R3p=Rvk/(Rpk+Rk), is 0.2 to 1.6; and wherein a texture height of the inner circumferential surface in the second axial portion, which is defined as R3k=Rpk+Rk+Rvk, is 0.4 μm or less.

2. The cylinder liner according to claim 1, wherein the first surface roughness has:

an Rpk<0.15 μm;

an Rk<0.5; and an Rvk of 0.2 μm to 1.5 μm.

3. The cylinder line according to claim 1, wherein the second surface roughness has:

an Rpk<0.05 μm;

an Rk<0.15 μm; and an Rvk<0.2 μm.

4. The cylinder liner according to claim 1, wherein:

the liner body further includes a third axial portion;

the third axial portion is formed one of cylindrically and conically, and opens at a third opening angle away from the second axial portion; and, the second axial portion, relative to the axial direction, is arranged between the first axial portion and the third axial portion.

5. The cylinder liner according to claim 4, wherein a third surface roughness of the inner circumferential surface in the third axial portion is smaller than the first surface roughness.

6. The cylinder liner according to claim 4, wherein the inner circumferential surface has a generatrix that at least one of:

follows a curved course in a longitudinal section along the axial direction of the third axial portion; and follows a straight line in a longitudinal section along the axial direction of the third axial portion.

7. The cylinder liner according to claim 4, wherein, relative to the axial direction, the third axial portion is disposed directly adjacent to the second axial portion.

8. The cylinder liner according to claim 4, wherein the third axial portion is cylindrical and the third opening angle is substantially 0°.

9. The cylinder liner according to claim 4, wherein the third axial portion is conical.

10. The cylinder liner according to claim 1, wherein a radial widening of the liner body in a direction perpendicular to the axial direction is 1 μm to 100 μm.

11. The cylinder liner according to claim 1, wherein the inner circumferential surface has a generatrix that at least one of:

follows a curved course in at least one of (i) a longitudinal section along the axial direction of the first axial portion and (ii) a longitudinal section along the axial direction of the second axial portion; and follows a straight line in at least one of (i) a longitudinal section along the axial direction of the first axial portion and (ii) a longitudinal section along the axial direction of the second axial portion follows a straight line.

12. The cylinder liner according to claim 1, wherein, relative to the axial direction, the second axial portion is disposed directly adjacent to the first axial portion.

13. The cylinder liner according to claim 1, wherein the first opening angle and the second opening angle are defined relative to the axial direction.

14. The cylinder liner according to claim 1, wherein the first axial portion is cylindrical and the first opening angle is substantially 0°.

15. The cylinder liner according to claim 1, wherein the first axial portion is conical.

16. The cylinder liner according to claim 1, wherein:

the plateau aspect is 0.6 to 0.8; and the texture height is 0.2 μm or less.

17. An internal combustion engine for a motor vehicle, comprising:

a cylinder liner delimiting an outer circumference of a cylinder bore;

a piston adjustably arranged in the cylinder bore, the piston adjustable in an axial direction of the cylinder liner between a top reversal point and bottom reversal point;

the cylinder liner including a hollow-cylindrical liner body extending along the axial direction, the liner body having an inner circumferential surface including a first axial portion and a second axial portion;

the first axial portion formed one of cylindrically and conically, and opening at a first opening angle towards the second axial portion;

the second axial portion opening at a second opening angle away from the first axial portion;

wherein the second opening angle is greater than the first opening angle;

wherein a first surface roughness of the inner circumferential surface in the first axial portion is greater than a second surface roughness in the second axial portion;

wherein a plateau aspect of the inner circumferential surface in the second axial portion, which is defined as R3p=Rvk/(Rpk+Rk), is 0.2 to 1.6;

wherein a texture height of the inner circumferential surface in the second axial portion, which is defined as R3k=Rpk+Rk+Rvk, is 0.4 μm or less; and wherein the top reversal point is arranged in the first axial portion of the cylinder liner.

18. The internal combustion engine according to claim 17, wherein the bottom reversal point is arranged in the second portion of the cylinder liner.

19. The internal combustion engine according to claim 17, wherein:

the liner body further includes a third axial portion;

the second axial portion is arranged between the first axial portion and the third axial portion relative to the axial direction; and the bottom reversal point is arranged in the third axial portion of the cylinder liner.

20. A motor vehicle, comprising an internal combustion engine according to claim 17.

* * * * *